United States Patent [19]

Stoddard et al.

[11] Patent Number: 4,463,602

[45] Date of Patent: Aug. 7, 1984

[54] ROCK CORE TEST UNIT VIBRATOR

[75] Inventors: Nyle S. Stoddard, Salt Lake; Scott W. Butters, Davis, both of Utah

[73] Assignee: Terra Tek Core Services, Inc., Salt Lake City, Utah

[21] Appl. No.: 426,121

[22] Filed: Sep. 28, 1982

[51] Int. Cl.[3] ..... G01N 1/08; B06B 1/04; B06B 1/12

[52] U.S. Cl. ..... 73/153; 73/864.44; 366/108

[58] Field of Search ..... 414/415; 366/117, 118, 366/108, 120, 123, 127, 128; 175/56, 84; 73/864.44, 864.45, 579, 153; 15/104.05

[56] References Cited

U.S. PATENT DOCUMENTS

| | | | |
|---|---|---|---|
| 2,960,317 | 11/1960 | Bodine et al. | 366/117 |
| 3,076,904 | 2/1963 | Kleesattel et al. | 366/117 X |
| 3,461,979 | 8/1969 | Newfarmer et al. | 175/56 |
| 3,465,974 | 9/1969 | Eckert et al. | 366/108 X |
| 3,865,501 | 2/1975 | Kniep et al. | 175/56 X |
| 4,307,964 | 12/1981 | Dudgeon et al. | 366/127 |

*Primary Examiner*—Gerald Goldberg
*Assistant Examiner*—Anna Schrichte
*Attorney, Agent, or Firm*—M. Reid Russell; Robert R. Mallinckrodt

[57] ABSTRACT

An invention in a rock core testing unit vibrator for generating a vibration at a controlled frequency for coupling to a barrel of a rock core test unit wherein a rock core cutting is jammed. In practice, the generator output is controlled to produce a harmonic or natural resonant frequency of the barrel of sufficient intensity to produce a resonant elastic vibration therein to shake that barrel relative to the rock core cuttings, dislodging the rock core cuttings that then fall therefrom under the urgings of gravity.

13 Claims, 10 Drawing Figures

ROCK CORE TEST UNIT VIBRATOR

DESCRIPTION OF THE INVENTION

1. Field:

The present invention relates to apparatus for use at a drilling rig platform to loosen for removal a rock core cutting jammed in a barrel of a core drill unit.

2. Prior Art:

Core drilling operations involve passage of a rock core wherethrough drilling is proceeding into a barrel of a drill string for later removal at the surface. Such cores are tested to determine the characteristics of porosity, permeability, hydro-carbon content, and the like. During collection, rock core is subjected to weight forces from the rock core above it in that barrel and is, in turn, pushed upwardly by the rock core entering that barrel. Therefore, it is often the case that the core will shear and jam within the barrel requiring, at the surface, that procedures be undertaken to shake or break that core loose. Such procedures vary and in the past have often involved banging the outside of the barrel with a hammer, dropping the barrel end onto the drilling platform floor, or the like. Such practice often damages the barrel, and when all else has failed, such jammed core has been physically reamed out the barrel, which reaming destroys the rock core's usefulness for testing. The present invention provides a simple and efficient apparatus and procedure to loosen, without damaging, such jammed core cuttings from within the barrel of a rock core test unit.

Vibrating the barrel as by striking it with a hammer, will often loosen such jammed rock core but may damage the barrel. The present invention provides for vibrating that barrel with sufficient energy to loosen such rock core but without damaging that barrel or the rock core by generating and passing a vibration into the barrel that is at an harmonic or natural resonant frequency of that barrel. Thereby, the barrel receives a resonant elastic vibration that will reinforce to release a large amount of energy to shake loose the rock core. Such vibration will generally not be an harmonic of the core and thereby a friction bond between the barrel wall and the core cutting will be broken, encouraging flow of the rock core out from the barrel under the force of gravity.

Heretofore, apparatus for generating a controlled frequency of vibration into an object have generally been for the purposes of enhancing flow. Such an arrangement to enhance flow of an aggregate material down a trough is shown in a U.S. Patent by Bodine, Jr., U.S. Pat. No. 3,472,431. Unlike this arrangement that involves a sonic oscillator vibrating at a frequency to produce a resonant elastic vibration between the individual particles in a granular flow, the present invention provides for vibrating to a resonant or natural frequency a metal barrel. The present invention therefore does not require imparting energy into the core cuttings themselves, but rather is concerned with establishing a resonant frequency in the barrel only. Additionally, the present invention, to provide for matching of the frequency of vibration output to the exact resonant frequency of the barrel, provides a feed-back arrangement for sensing a natural resonant frequency in the barrel.

SUMMARY OF THE INVENTION

It is, therefore, the general object of the present invention in a rock core test unit vibrator to provide an apparatus for generating a vibration that is at an harmonic or natural resonant frequency of a barrel of a rock core test unit wherein rock core cuttings are jammed, and for coupling the output of that vibrator to that barrel so as to pass that vibration at sufficient intensity into that barrel to establish a resonant elastic vibration therein to dislodge jammed rock core cuttings.

Another object of the present invention is to provide a vibrator for coupling to a barrel of a rock core test unit to impart thereto a vibration that is at the resonant frequency of that barrel so as to loosen packed rock core cuttings therein without damaging or compromising the roundness of that barrel and with little or no damage to the rock core.

An additional object of the present invention is to provide apparatus for loosening jammed rock core cuttings from the barrel of a rock core test unit that can be used in a field setting, and is simple and efficient to operate by a worker who needs only minimum training and experience.

In accordance with the above objects, the present invention in a rock core test unit vibrator includes a generator apparatus capable of producing, as an output therefrom, a vibration at an harmonic or natural resonant frequency of an barrel of a rock core test unit and is of sufficient intensity to initiate and support an harmonic vibration therein. The invention provides, in one embodiment, a vibrator that incorporates solenoid operated hammers. The hammers are arranged to sequentially strike a metal shoe that is mounted to a housing that closes in clamshell fashion around the barrel so as to provide a metal-to-metal transfer of an energy into the barrel. The solenoids are sequentially operated in pairs, the one solenoid across from the other with the barrel therebetween, the solenoids extending pistons therefrom with hammer ends. The hammers strike the metal shoe that transmits the vibration into the barrel to provide a reinforcing resonant elastic vibration therein.

The solenoid operated hammer embodiment of the vibrator preferably includes the clamshell opening housing that consists of two equal halves that are hinge connected along joining edges, the clamshell housing to close around a metal shoe. The metal shoe is formed from two equal halves that fit together to form a ring around the barrel. So arranged, operation of the solenoids in pairs is synchronized to vibrate that shoe an the barrel closely held thereagainst. Each pair of solenoids is operated sequentially, the hammers striking with sufficient force to impart a vibration into the shoe that is transmitted into the barrel to produce a resonant elastic vibration therein to shake loose the jammed rock core cuttings.

Appropriate circuitry is provided for timing solenoid pair operation, with the individual solenoid operated hammer, striking opposite sides of the shoe with a lapse time provided for cycling between solenoid pair operation that provides for staggered firing so as to produce the desired vibration in the barrel. Additional to the above-described circuitry operation for controlling solenoid firing, the preferred embodiment includes feedback circuitry for sensing a resonant condition in the barrel. This feedback circuitry can provide for control of the period between solenoid pair operation.

Additional to the solenoid operated hammer vibrator, as another embodiment, the present invention teaches an arrangement of orbiting masses that are turned within openings formed in oppositely extending coplaner sides or wings of a collar. The collar is arranged for connection to the barrel and the masses are either turned off-center to provide a vibration at a desired frequency by the amount of weight differential and speed of turning, or the masses are turned on center with ends thereof striking the sides of the openings wherein they are turned to produce the desired frequency of vibration.

Another vibrator embodiment provides a housing for coupling around a barrel, like those described above, that includes a pair of flat speakers arranged such that the speaker cones point inwardly towards one another, the barrel arranged therebetween. The speaker outputs are directed into opposite sides of the barrel to produce therein the desired frequency of vibration.

Still another vibrator embodiment includes a housing for clamping around the barrel, as described above, that contains electro-magnetic coils. The coils are arranged such that when an electrical current is passed therethrough, a magnetic force of attraction and repulsion will be produced between the coil ends to vibrate the barrel therebetween at its resonant frequency.

As with the solenoid vibrator embodiment, all the vibrator embodiments preferrably include feed-back circuitry whereby a resonant state can be sensed in the barrel and the vibrator output closely adjusted to match and maintain that resonant frequency of vibration in the barrel.

BRIEF DESCRIPTION OF THE DRAWINGS

In the drawings that illustrate that which is presently regarded as the best mode for carrying out the invention.

DETAILED DESCRIPTION

Figure 1:
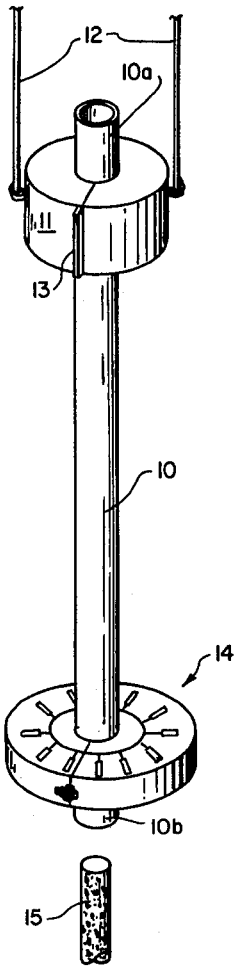
FIG. 1 is a perspective view of a barrel of a rock core test unit shown hanging vertically from a clamping block arrangement, the barrel shown as including a solenoid operated hammer embodiment of a vibrator of the present invention, and showing a section of a rock core falling from the barrel.

Referring now to the drawings:

FIG. 1 shows a perspective view of a barrel 10 of a conventional rock core test unit as would be involved in core drilling operations suspended from block 11. Block 11 is, in turn, supported by cables 12, and a rock core or core cuttings 15 are shown falling from an open end **10*b*. The core, it should be understood, has been jammed therein and has been broken loose by operation of a solenoid operated vibrator 14**, hereinafter referred to as vibrator, as will be explained in detail herein.

Block 11 shown in FIG. 1 should be understood to be standard to a drilling rig and is simplified for explanation of the present invention to consist of two halves that can be closed together around a hinge, not shown, and locked together at coupling 13 for clamping around an end **10*a* of barrel 10. The opposite barrel end 10*b*, as shown in FIG. 1 and in the exploded view of FIG. 2, has the vibrator 14 mounted thereto. Vibrator 14 provides an impact vibration output therefrom that is transmitted into the barrel 10 at the harmonic or natural resonant frequency of that barrel. The barrel is thereby vibrated at its resonant frequency, the vibration building to release a large amount of energy in barrel 10 so as to shake the barrel relative to the jammed rock core. The rock core 15** is thereby freed and falls, under the urgings of gravity, onto the drilling platform for use in later core testing procedures.

Figure 2:
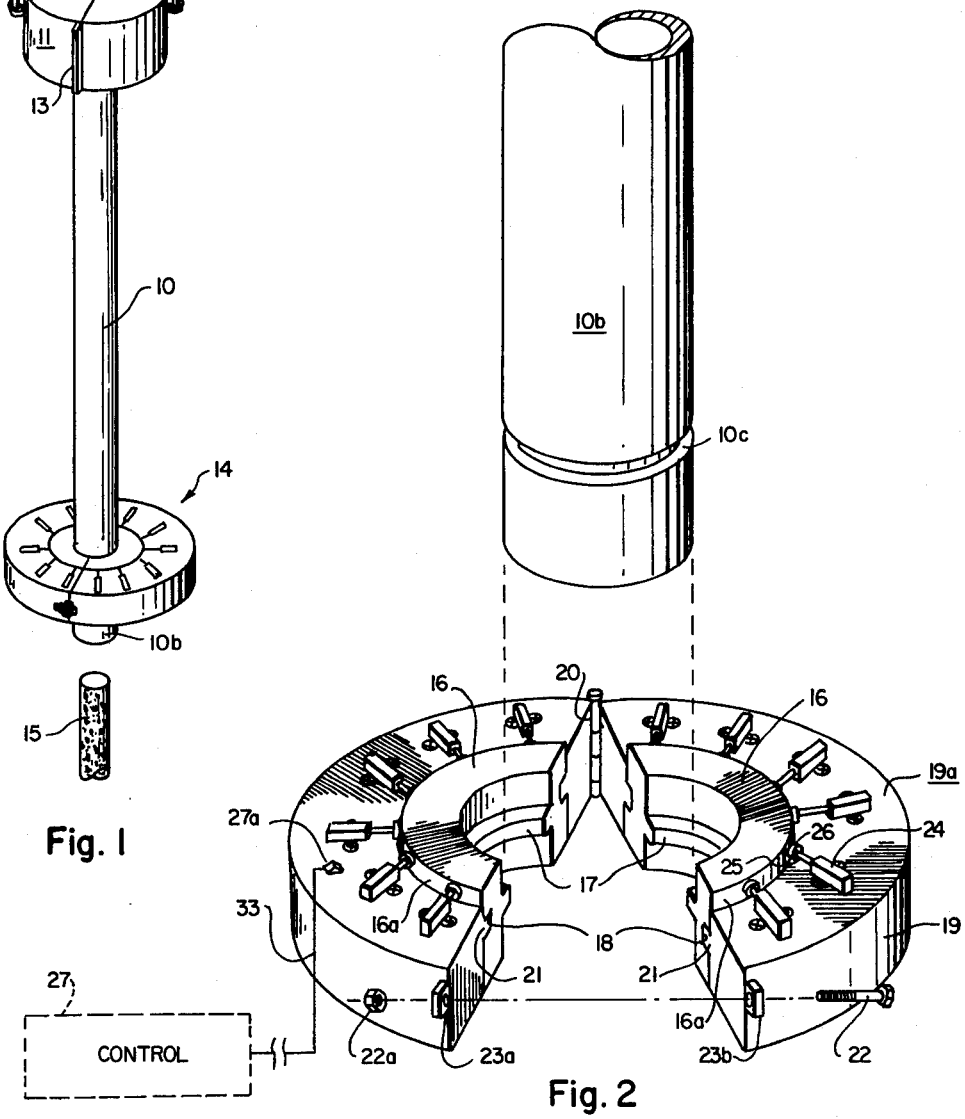
FIG. 2 is an exploded perspective view of a section of the barrel of FIG. 1, showing that the barrel has a continuous groove formed therearound to receive equal halves of shoe that is fitted to a clamshell opening body that is closed to clamp the shoe in metal-to-metal contact to the barrel, showing hammer ends of solenoids pointing inwardly that, when extended will strike the shoe, and showing a plug connected to a broken-line box labeled control to illustrate circuitry to sequentially operate the solenoids.

FIG. 2 shows an exploded view of the barrel end **10*b* to include a groove 10*c* formed therearound. A metal shoe 16, that is formed in two halves, is provided for coupling to barrel end 10*b*. The asembled shoe has a continuous ridge 17 formed to project inwardly from around the inner circumference thereof to fit in groove 10*c*, the shoe closing as a collar around that barrel. The metal shoe also includes a continuous groove 18 formed around its outer circumference, whereover a vibrator body 19 is positioned. Vibrator body 19 is also formed in two halves that are connected at hinge 20 along edges thereof to open and close in clamshell fashion and is formed to closely fit around shoe 16. To provide the required aligned coupling to metal shoe 16, the vibrator housing 19 includes a continuous ridge 21 formed therein that extends outwardly from around the inner circumference to fit within the groove 18 of metal shoe 16. So arranged, the vibrator housing 19 when closed around shoe 16, provides a rigid coupling thereto. The two body halves 19** can be locked together by any appropriate fastener arrangement. A preferred fastener is shown in FIG. 2 as consisting of a bolt 22 fitted through aligned openings formed through tabs 23*a* and 23*b* that are secure to extend outwardly from along opposing edges of the housing halves. A nut 22*a* is provided to turn over the bolt 22 threaded end to hold the tab surfaces together.

A top surface 19*a* of the closed vibrator body 19 provides a flat surface that intersects, at a right or normal angle, an upstanding ridge 16*a* of the shoe 16 outer circumference as shown in FIGS. 1 and 2. Solenoids 24 are secured to the top surface 19*a*, that are equidistantly spaced therearound, and point inwardly towards a vertical centerline through the vibrator body. Thereby, pistons 25 that extend from each solenoid will point towards the body centerline which is also the longitudinal centerline of an installed barrel 10. Of course, to provide a desired force of impact on the barrel that is sufficient to initiate a vibration in the barrel at its natural resonancy, the solenoid driven hammer 26 end of each piston 25 need be of sufficient mass and be moved at a sufficient acceleration by operation of solenoid 24 to provide a required impact force. The present invention, it should be understood, is not limited to any particular type or brand of solenoid, nor is it limited to a particular configuration of piston and hammer end arrangement therewith.

From the formula: Force=Mass×Acceleration; the operation of a solenoid 24, or of solenoids 24 in pairs, must be such as to provide a required impact force to impart a vibration into the barrel sufficient strength and at the resonant frequency thereof to establish and maintain a reinforcing frequency vibration therein.

Figure 3:
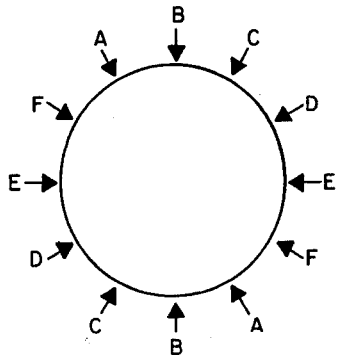
FIG. 3 is a schematic of a cross-section of the barrel showing, with inwardly pointing lettered arrows, the preferred firing order of the solenoid operated hammers of the vibrator embodiment of FIGS. 1 and 2.
Figure 5:
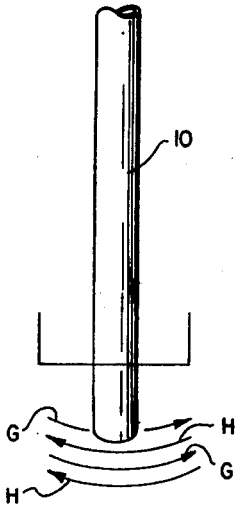
FIG. 5 is a schematic of a barrel whereto a vibrator is mounted imparting as shown by arrows G and H, a back and forth vibration thereto.

Two solenoids 24 can be operated, one after the other, to impart the required force or impact on barrel 10, and, with that operation appropriately synchronzied, and of sufficient mass and force, as set out above, a resonant frequency of vibration can be established in that barrel. Such a vibration as will be explained later herein, is shown in the schematic of FIG. 5. However, it is preferred to utilize an arrangement of more than two solenoids 24. Vibrator 14, as shown in FIG. 2, preferably incorporates twelve (12) solenoids 24. Solenoids 24, as illustrated in the schematic of FIG. 3, are preferably operated in pairs, the sequency of firing of those pairs illustrated as arrows A, B, C, D, E and F, respectively, with an equal time lapse set between each pair operation. Utilizing the twelve (12) solenoids 24 as shown, a lapse time between solenoid pair firings of approximatley thirty-five (35) micro seconds will provide a desired staggering.

Of course, when a resonant frequency of barrel 10 is reached, the vibrations will no longer be dampened as occurs when a frequency other than a resonant frequency is passed into an object. Thereafter, a continued input at the barrel's resonant frequency reinforces itself and causes the release of a large amount of energy to oscillate or shake the barrel, freeing a rock core or core cuttings 15 jammed therein. The rock core 15 will thereafter fall, as shown in FIG. 1, under the urgings of gravity, out from barrel end 10*b*. To provide the necessary vibration, the present invention preferably adopts the firing scheme shown in FIG. 3. While, of course, the length and the material properties of a particular barrel 10 will govern the resonant frequency thereof, an approximation of an barrel's resonant frequency can be made based on its length. As, for example, a fifty (50) foot barrel has been found in practice to have a resonant frequency of approximately eighty (80) $H_z$, and a thirty (30) foot barrel has been found in practice to have a resonant frequency of approximately from thirty-eight (38) to forty (40) $H_z$. While such resonant frequency can be estimated, it is preferred to include with the invention, a feedback circuit arrangement that will sense the presence of a resonant vibration in the barrel to provide for control of the timing and, optionally, the piston impact force of solenoid operation. Thereby, the timing of solenoid 24 firing can be controlled to exactly match the resonant frequency of a particular barrel 10.

Figure 2A:
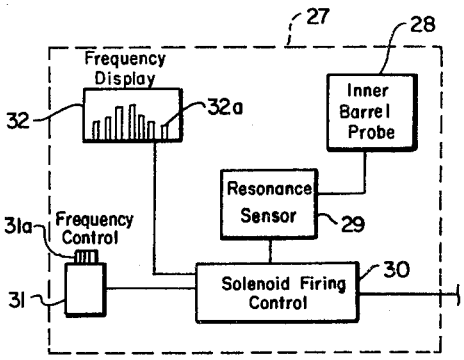
FIG. 2A shows a block flow schematic of electrical circuitry for sensing a resonant vibration in the barrel and to control vibrator output to produce and match that resonant frequency of vibration.

A preferred arrangement for controlling solenoid 24 operation, that can also be used for controlling operation of the other vibrator embodiments described herein below, is illustrated in the schematic of FIG. 2A, and is shown also as a broken line box 27 in FIG. 2. Shown in FIG. 2A, the control 27 preferably includes an barrel probe 28, that may be a collar, or a like arrangement, for physical connection to the barrel to sense the presence of a resonant vibration therein. The presence of such resonant state indicates that the solenoids 24 are firing at proper time intervals and with sufficient force. The indication of a resonant state of barrel 10 is passed as a signal to a resonance sensor 29 that passes an appropriate signal to a frequency display that provides a visual indication at 32*a* of this state. Also, the resonance sensor passes a signal to a solenoid firing control 30 to adjust or maintain the pair solenoid firing intervals. Adjustment of that firing interval, as shown in FIG. 2A, is provided by a frequency control 31, which control can operate automatically or, as shown therein, can include a knob 31*a* for use by an operator to manually vary the solenoid operation lapse time to achieve the desired output vibration frequency, with a resonance state shown at frequency display 32.

The circuitry of FIG. 2A, is preferably linked through a cable or like electrical line 33 to a plug, or like connector 27*a* that is arranged on the top 19*a* of vibrator body 19. This connector electrically links by wiring within the vibrator body, not shown, the individual solenoids to the control 27 for providing firing signals thereto. Of course, the individual solenoids 24, and the control 27 are connected to a source of electrical power, not shown, to operate as described above.

Additional to vibrator 14, the present invention preferably includes other embodiments of vibrators, as illustrated in FIGS. 4, 4A, 6, 6A, 7 and 7A. Shown therein, are, respectively, vibrator embodiments 40, 50 and 60 that illustrate mechanical, audio, and magnetic arrangements for introducing back and forth vibrations, as illustrated in FIG. 5, into inner-barrel 10. It should be understood that vibrators 40, 50 and 60, all preferably include circuitry like that shown in FIG. 2A to provide a feedback signal for controlling vibrator output and indicating the presence of a resonant condition within barrel 10.

Figure 4:
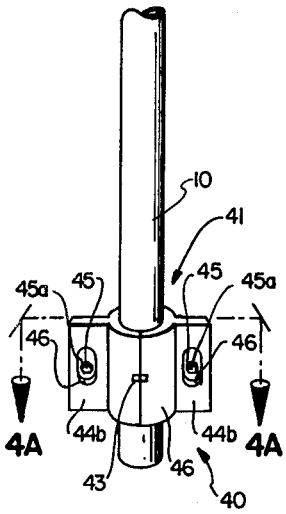
FIG. 4 shows another embodiment of a vibrator of the present invention for coupling to a barrel of a rock core test unit that includes a collar, for clamping to the barrel, wherein are shown openings that accomodate masses or cams turned therein to produce a vibration of a desired frequency.
Figure 4A:
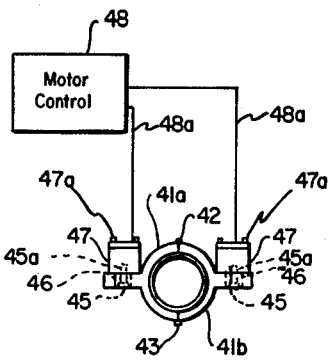
FIG. 4A shows a top plan sectional view taken along the line 4A—4A of FIG. 4 and including a block labeled motor control.

As shown in FIG. 4, and in the sectional view of FIG. 4A, vibrator 40, is an orbiting mass oscillator that includes a body 41 that consists of halves 41*a* and 41*b*. The body halves are pivotally connected to one another along one common edge by a hinge 42 and include a coupler 43, or the like arranged to releasably connect the other two common edges together, as shown in FIG. 4. Coupler 43 can be like the fastener shown in FIG. 2, or can be any similar arrangement. So arranged, the two vibrator halves 41*a* an 41*b* can be secured around barrel 10, as shown in FIGS. 4 and 4A.

The vibrator halves 41*a* and 41*b* each preferably include co-planar housing extensions or wings 44*a* and 44*b* that extend outwardly and oppositely from the housing that each have openings 46 formed therein. Shown in FIG. 4, and in broken lines in FIG. 4A, an orbiting mass 45 can be axially connected off-center to shafts 45*a* to be turned by motors 47. Motors 47 are coupled to wings 44*a* and 44*b* at 47*a* such that turning thereof creates a vibration. That vibration is dependent upon the weight differential between the orbiting mass ends, the moment arm of which it operates, and its speed of turning. This vibration is passed into the barrel 10. Or, optionally, the orbiting masses 45 can be axially connected to shafts 45*a* that are turned by the motors 47, which motors in the arrangement are flex mounted at couplings 47*a* to the wings 44*a* and 44*b*. In this arrangement, the orbiting mass 45 ends are arranged to strike and repel off the walls of the openings 46, which openings are contoured appropriately to accommodate being struck by a surface of said turning mass 45 and repelling that mass after the striking. Such flex mounting the motors 47 can involve springs, gaskets, or the like, not shown to allow one side or the other of the motor to lift appropriately on its coupling 47*a* to allow the orbiting mass 45 to lift off the opening surface and to continue turning and striking the wall of opening 46. FIG. 4A shows, in association with motors 47, a block identified as a motor control 48. The motor control 48 is like the above-described control 27 and is linked electrically through lines 48*a* to provide control signals to the individual motors 47 for synchronizing turning of shafts 45*a* whereon the orbiting masses 45 are connected.

By controlling the vibration intensity and output frequency generated by the orbiting masses 45, a vibration at a certain frequency can be passed into the barrel, which vibration will be at its natural resonant frequency, to, as set out hereinabove, provide for an energy release therein to shake that barrel so as to dislodge a jammed rock core or rock core cuttings.

Figure 6:
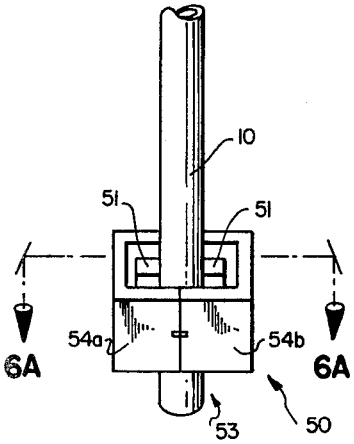
FIG. 6 shows another embodiment of a vibrator that is mounted to a barrel and utilized flat speakers to produce a sound vibration output that is directed therein.
Figure 6A:
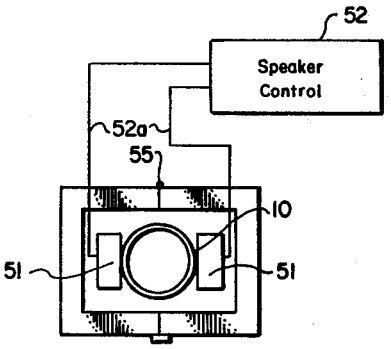
FIG. 6A is a top plan sectional view taken along the line 6A—6A of FIG. 6, showing a preferred arrangement of the speakers of the vibrator of FIG. 6 and including a speaker control therewith.

In FIG. 6, is shown a schematic of a vibrator 50, which vibrator is shown in cross-sectional view in FIG. 6A. Shown therein, vibrator 50 constitutes an embodiment of an audio vibrator and includes a pair of flat speakers 51 that are positioned directly opposite to one another, such that the barrel 10 will be positioned therebetween.

The vibrator 50 includes a housing 53 that preferably consists of two halves 54*a* and 54*b*. The housing halves are connected along a common edge at hinge 55 to open in clamshell fashion, which halves can be closed and latched together at a coupling 56, that is preferably like the couplings described above. The flat speakers 51 are arranged, as shown in FIG. 6A such that the outputs therefrom will be directed against opposite surfaces of barrel 10. While not shown, the lower portions of housing halves 54*a* and 54*b* below the flat speakers 51 should be understood to be arranged to contact and bind against the opposite surfaces of barrel 10, locking thereto, when the housing halves are clamped together. As with the described vibrators 14 and 40, vibrator 50 preferably also includes circuitry, shown as a speaker control 52 that is linked by wires 52*a* to the individual speakers. Speaker control 52 is like and functions like that shown in the schematic of the control 27 FIG. 2A to control the individual speaker output so as to impart a desired vibration into the barrel 10, illustrated by arrows G and H in FIG. 5. As with the earlier desribed vibrators, the vibration output should be of sufficient power and at a frequency such as to produce a vibration of a harmonic or natural resonant frequency in that barrel 10. Thereby, this vibration input will reinforce itself to provide a release of energy in the barrel to dislodge, as described above, a rock core or rock core cuttings from that inner-barrel.

Figure 7:
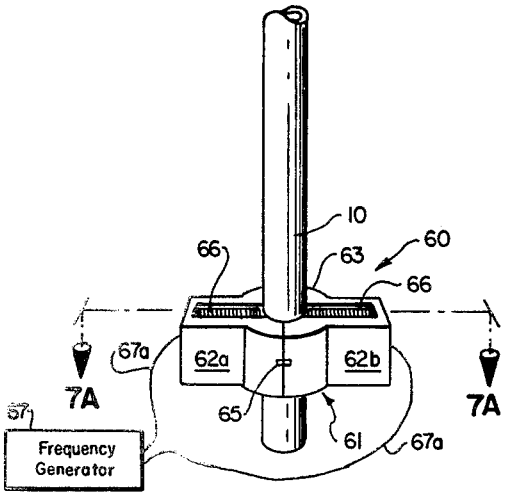
FIG. 7 is still another embodiment of a vibrator for releasable attachment to the barrel that includes electromagnetic coils that are arranged across from one another with the barrel therebetween.
Figure 7A:
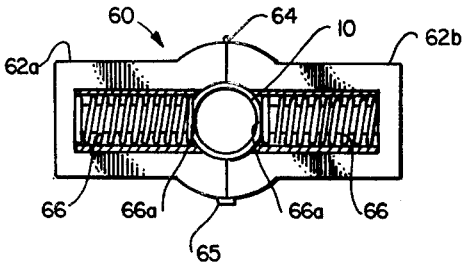
FIG. 7A is a top plan sectional view taken along line 7A—7A of FIG. 7, showing the arrangement of the electro-magnetic coils of the vibrator embodiment of FIG. 7 that are individually connected to a frequency generator not shown.

The schematic of FIG. 7 and the sectional view thereof of FIG. 7A show still another embodiment of a vibrator 60. Vibrator 60, similar to the above-described vibrator embodiments, includes a housing 61 that incorporates co-planar sections or wings 62*a* and 62*b* that extend outwardly from along opposite vertical sides of a cylindrical body 63. The two halves are also arranged to open in a clamshell fashion around a hinge 64, as shown in FIG. 7A, and can be locked together at a fastener 65, that is preferably like the connectors described above. The vibrator 60 is arranged to provide an electromagnetic output that is directed into the barrel 10 by operation of coils 66. The coils are arranged, as shown best in FIG. 7A, in wings 62*a* and 62*b* to point outwardly towards barrel 10. Each coil is individually electrically connected through wires 67*a* to a frequency generator 67, that is shown as a box. The frequency generator 67 functions like control 27 to appropriately pass electrical current to the coils 66 to produce a magnetic flux therearound that changes direction to create a vibration in barrel 10 that is at the resonance frequency of that barrel. The electrical coils 66 are sequentially energized, first push then pull against the barrel, to provide, as illustrated in FIG. 5, back and forth vibrations thereto that are at an harmonic or natural resonant frequency thereof. A reinforcing vibration is produced thereby that releases a large energy output to shake loose, as described above, the rock core or rock core cuttings. As with the earlier described vibrator embodiments, the vibrator 60 also includes circuitry like that shown in FIG. 2A, for sensing the presence of a resonant state within the barrel and for controlling vibrator output such that the induced vibration in the barrel will achieve and remain at the resonant state to effect a maximum energy release.

Set out hereinabove are examples of arrangements of vibrators that produce an energy vibration as an output for transmission into a barrel 10 wherein a rock core or rock core cuttings are jammed. It should, however, be understood that other arrangements capable of producing and transmitting such vibrations into at an harmonic or natural resonant frequency thereof that are of a required intensity to produce the desired oscillation in that barrel could be substituted for the described vibrators within the scope of this disclosure. The present disclosure is, therefore, not limited to a particular vibrator arrangement. Also, while circuitry for sensing and feeding back an indication of the presence of a resonant state has been shown herein in block flow schematic, it should be understood the individual components and circuitry therewith are common and readily available electronic parts and systems and so have not been described in detail herein. It should further by understood that such feedback circuitry is optional and that the harmonic or natural resonant frequency of a barrel can be calculated, taking into account its dimensions and material composition, and the vibrator set appropriately. Therefore, while such feedback circuitry is preferred, any of the described vibrators could be arranged to provide an output vibration at a frequency that is dependent upon the configuration of the particular barrel to, in most cases, dislodge a jammed rock core or rock core cuttings therefrom.

While the preferred vibrators and arrangements for their use for vibrating a barrel portion of a rock core test unit at its natural or resonant frequency to dislodge a jammed rock core or rock core cuttings therefrom has been shown and described herein, it should be understood that the present disclosure is made by way of example only, and that variations to the described apparatus and its use are possible without departing from the subject matter coming within the scope of the following claims, which claims I regard as my invention.

I claim:

1. A rock core test unit vibrator consisting of, a housing arranged for releasable coupling to a barrel of a rock core test unit wherein a rock core is deposited, the housing providing a mount whereto a vibrator means is secured such that an output therefrom is directed into said barrel; means for supporting said barrel above the horizontal such that gravity will act on said rock core deposited therein to draw said rock core therefrom; and vibrator means secured to said housing arranged to generate an output vibration for transmission into said barrel that is of sufficient intensity and is at a frequency to produce a vibration in said barrel that is at the barrel resonance frequency to vibrate that barrel so as to dislodge said rock core deposited therein.

2. A rock core test unit vibrator as recited in claim 1, further including means for sensing the presence of a resonance vibration within the barrel and for passing an indication of said condition to means for controlling the output vibration; and means for controlling the output frequency of vibration from the vibrator means connected to said means for sensing the presence of a resonance vibration to pass control signals to said vibrator means.

3. A rock core test unit vibrator as recited in claim 2, wherein the means for controlling the output frequency of vibration also provides a means for displaying the frequency of the output vibration.

4. A rock core test unit vibrator as recited in claim 2, wherein and the means for controlling the output frequency of vibration is a manually operated control.

5. A rock core test unit vibrator as recited in claim 1, wherein the vibrator means includes electrically operated solenoid means secured at spaced intervals around the housing that, when the housing is secured to the barrel, extend piston portions thereof towards a longitudinal centerline of said barrel; means arranged with the housing to be struck by said extending piston portions to transmit that vibration therethrough into said barrel; and means for controlling operation of said solenoid means

6. A rock core test unit vibrator as recited in claim 5, wherein twelve (12) solenoids are provided as the solenoid means that are spaced equidistantly apart from one another around the housing, each to extend, when operated, its piston portion such that the end thereof will strike the vibration transmitting means, which solenoids are operated to sequentially fire in pairs, one on each side of the barrel, and including means for setting a uniform time delay between solenoid pair firing; and hammer means arranged as each piston portion end for striking said vibration transmitting means.

7. A rock core test unit vibrator as recited in claim 5 wherein the vibration transmitting means consists of, a shoe formed in sections to fit between the housing and the barrel as a collar around said barrel when said housing is coupled thereto, which shoe is formed of a metal to faithfully transmit a vibration therethrough and into said barrel produced by the impact of a solenoid piston portion hammer end thereagainst.

8. A rock core test unit vibrator as recited in claim 1, wherein the vibrator means includes, cam means journaled to be turned in openings formed in coplanar wings that extend from the housing such that, when said housing is coupled with the barrel, said barrel is between and spaced equidistantly from said cam means; means for turning said cam means to generate a vibration from said turning for transmission through said housing into said barrel, which vibration is such as to produce a resonance vibration in said barrel; and means for controlling turning of said cam means.

9. A rock core test unit vibrator as recited in claim 8, wherein the cam means are axially connected to the means for turning such that more of the mass of each cam means is on one side of the axial connection than is on the other and turning thereof produces a vibration at a frequency and intensity governed by the weight differential across the axial connection of each cam means and speed of turning.

10. A rock core test unit vibrator as recited in claim 8, wherein the cam means is arranged such that when each is axially turned in a housing opening, a part of each cam means is arranged to strike and repel off from a surface of said opening, which opening is shaped to enable the repelling off therefrom of that cam means, producing, by that impact, a vibration that is transmitted to the barrel; and the means for turning said cam means is mounted to said housing to flex appropriately with said axially connected cam means, enabling the cam means to repel off said opening surface.

11. A rock core test unit vibrator as recited in claim 1, wherein, the vibrator means consists of, speaker means, including at least one pair of speakers arranged in said housing that include output cones wherefrom sound produced by each speaker is directed from an open end, output cones facing each other with the inner-barrel arranged therebetween, when said housing is secured thereto; and means for sequentially operating said speakers to produce an audio output vibration from each output cone that acts upon said barrel to produce a vibration therein that is at the barrel resonance frequency.

12. A rock core test unit vibrator as recited in claim 11, wherein the speaker means are a pair of flat speakers that are sequentially operated, one after the other, to produce equal vibration outputs thereform.

13. A rock core test unit vibrator as recited in claim 1, wherein the vibrator means consists of, electrical coil means arranged in the housing such that, when said housing is coupled to the barrel, said barrel will be positioned between said electricl coil means, said coil means connected to receive electrical current therethrough to generate a magnetic field that will produce a vibration in said barrel that is at the resonance frequency thereof, and means connected to said electrical coil means for sequentially passing electrical current to said coil means to produce a magnetic field therearound that pushes then pulls against the barrel at sufficient energy to induce the desired resonance frequency therein.

* * * * *